US007780148B2

(12) United States Patent
Kirby

(10) Patent No.: US 7,780,148 B2
(45) Date of Patent: Aug. 24, 2010

(54) VORTEX GENERATING SAND AND SNOW FENCE

(75) Inventor: James H. Kirby, Dunedin, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 11/381,830

(22) Filed: May 5, 2006

(65) Prior Publication Data

US 2006/0249720 A1 Nov. 9, 2006

Related U.S. Application Data

(60) Provisional application No. 60/677,921, filed on May 5, 2005, provisional application No. 60/713,155, filed on Aug. 31, 2005.

(51) Int. Cl.
*E01F 7/02* (2006.01)

(52) U.S. Cl. ..... 256/12.5

(58) Field of Classification Search ..... 256/12.5, 256/24, 32, 34, 25, 27; 405/29
See application file for complete search history.

(56) References Cited

U.S. PATENT DOCUMENTS

| | | | | | |
|---|---|---|---|---|---|
| 155,660 | A | * | 10/1874 | McGinty | 256/34 |
| 1,541,241 | A | * | 6/1925 | Baxter | 256/12.5 |
| 1,709,787 | A | | 4/1929 | Glanzer | |
| 1,932,762 | A | * | 10/1933 | Whiting | 140/32 |
| 2,020,379 | A | * | 11/1935 | Ruppel | 256/34 |
| 3,204,606 | A | * | 9/1965 | Parr et al. | 119/514 |
| 3,218,035 | A | * | 11/1965 | Dunlap | 256/12.5 |
| 3,386,250 | A | * | 6/1968 | Katayama | 405/33 |
| 3,651,851 | A | * | 3/1972 | Curtis | 160/135 |
| 3,797,787 | A | | 3/1974 | Watanabe | |
| 3,815,877 | A | * | 6/1974 | Turner | 256/24 |
| 3,966,172 | A | | 6/1976 | Garrett | |
| 4,000,618 | A | * | 1/1977 | Stovall | 405/60 |
| 4,529,173 | A | * | 7/1985 | Kramer et al. | 256/12.5 |
| 4,549,724 | A | * | 10/1985 | Taillandier | 256/12.5 |
| 4,710,057 | A | * | 12/1987 | Laier | 405/30 |
| 5,131,630 | A | | 7/1992 | Nash | |
| 5,758,868 | A | | 6/1998 | Shea | |
| 5,779,227 | A | * | 7/1998 | Elkins et al. | 256/31 |
| 5,901,507 | A | * | 5/1999 | Smeja et al. | 52/24 |
| 6,053,479 | A | | 4/2000 | Lang et al. | |
| 6,499,911 | B2 | | 12/2002 | Hillard et al. | |
| 6,626,611 | B2 | | 9/2003 | Winters et al. | |
| 6,863,473 | B1 | * | 3/2005 | Tucker | 405/25 |
| 2006/0067790 | A1 | * | 3/2006 | Tabler | 405/15 |

* cited by examiner

*Primary Examiner*—Daniel P Stodola
*Assistant Examiner*—Joshua T Kennedy
(74) *Attorney, Agent, or Firm*—Michele L. Lawson; Smith & Hopen, P.A.

(57) ABSTRACT

A sand dune or snow fence having slats with a substantially triangular cross-section, rather than rectangular slats. The slats are arranged to eliminate parallel surfaces there between such that air moving between the slats is not compressed or accelerated. The non-parallel surfaces provided by the triangular slats disrupt the flow of air and generate vortices. One configuration includes multiple wings radiating from a center post and anchored on each end by an end post. The asterisk-pattern of this configuration provides a robust structure sufficient to survive extreme weather. Accordingly, this design provides the additional benefit of eliminating the cost associated with replacing damaged and lost fences of the prior art.

6 Claims, 6 Drawing Sheets

VORTEX GENERATING SAND AND SNOW FENCE

CROSS REFERENCE TO RELATED APPLICATIONS

This application claims priority to currently pending U.S. Provisional Patent Application 60/677,921, filed May 5, 2005 and currently pending U.S. Provisional Patent Application 60/713,155 filed Aug. 31, 2005.

FIELD OF INVENTION

This invention relates to a method of making snow and sand dune fences. Sand dune and snow fences of the prior art tend to scour in certain wind conditions. These fences cause erosion at the base of the fence, rather than accreting snow or sand.

Therefore, what is needed is a snow or sand dune fence that disrupts the lift generated by spinning particles and causes them to fall out of transport.

SUMMARY OF INVENTION

The present invention provides a drift fence comprising a plurality of triangular slat members with spacer elements disposed between the slat members to form fence wings or walls. The slat members are arranged to eliminate parallel surfaces between the slats where air travels.

In one embodiment, the present invention includes a center post with a plurality of wings (walls) radiating outwardly therefrom. The fence wings, usually about six (6) in number, terminate in end posts which are driven into the ground. The number six (6) is not critical; any plurality of at least three(3) walls arrange in a radial configuration relative to a central post provides the lift-disrupting effect. This configuration provides an asterisk-like pattern that is both useful in varying wing conditions and particularly strong. In another embodiment, four fence wings are combined to form a box or diamond structure.

One side of each triangular slat member constitutes a hypotenuse if said triangular slat member has the configuration of a right triangle. In one embodiment, the hypotenuse of each slat member of right triangle configuration is substantially parallel to the longitudinal plane of the drift fence. The vertex of each of the triangular slat members is disposed on the trailing side of the drift fence.

In an alternate embodiment, the hypotenuse of each triangular slat member that forms a right triangle is disposed about forty-five degrees (45° ) to the longitudinal plane of the drift fence. Here the hypotenuse of each triangular slat member that forms a right triangle faces the trailing side of the drift fence. In most embodiments, the hypotenuse of the triangular slat members that form a right triangle are in substantially parallel relation to each other.

The present invention also provides for an array of drift fences comprising a first row of drift fences, having a plurality of triangular slat members, spaced apart by a predetermined distance. It is also possible to incorporate a second row, or more, of drift fences, having a plurality of triangular slat members, spaced apart by a predetermined distance. The array can include drift fences of any configuration, including the asterisk-pattern and diamond or box-pattern discussed above.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention. All references to dimensions are for example only. While the dimensions provided below provide advantages such as ease of manufacturing, shipping and storage, other dimensions are envisioned and do not deviate from the scope of the invention.

The novel structure includes triangular slats, rather than the rectangular slats of the prior art. One can eliminate parallel surfaces, across which air moves as it passes through the fence, by arranging the triangular slats correctly. Moving air through two parallel surfaces causes the air to compress and accelerate. This acceleration causes scour at the bottom edge of the fence. The non-parallel surfaces of the novel structure, however, causes a sudden disruption to the flow of air through the fence slats; thereby generating vortices.

Vortices reduce the amount of lift that is present in ground effect as the particles move over the surface of the ground. Specifically, one embodiment of the present invention, shown in FIGS. 1 and 2, uses a right triangle design for vortex generation. Slats 20 can be woven together like the sand fences of the prior art, by using two strands of wire 25 for each line (upper 25*a*, middle 25*b*, lower 25*c* shown in FIG. 3) of the fence section. The number of slats in each section can vary depending on the intended use of the fence. Most commonly, the number of slats in each section will vary from 20 to 24.

Figure 1:
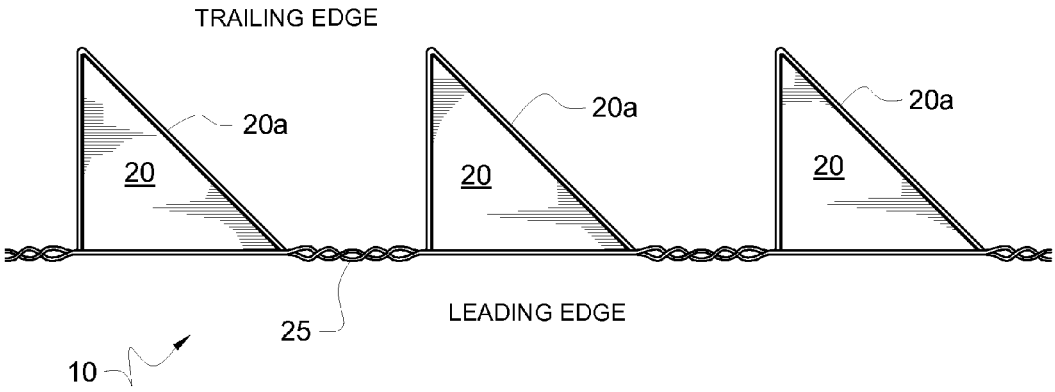
FIG. 1 is a cross-section of a fence section showing the relation of the diagonal surfaces of the individual slats, wherein the hypotenuse side of each slat is arranged at about 45 degrees to the weaving wire.
Figure 2:
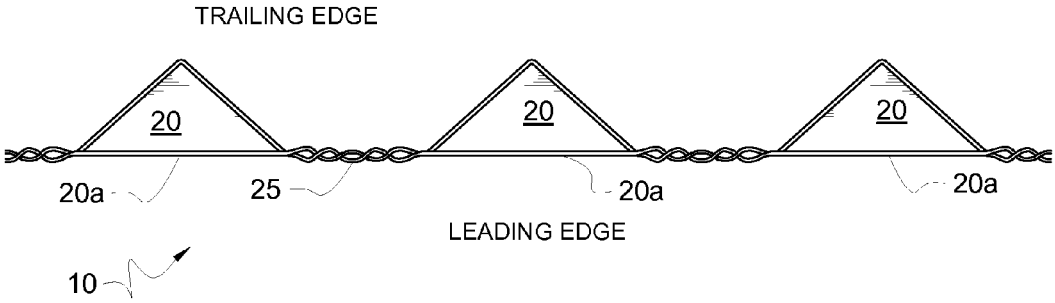
FIG. 2 is a cross-section of a fence section showing the relation of the diagonal surfaces of the individual slats.

In one embodiment, the triangular slats are oriented to have its diagonal surfaces arranged in the wire such that the corresponding surfaces of successive slats are parallel. For example, hypotenuse side 20*a* is formed where slats 20 are formed as right triangles. In FIG. 1, the hypotenuse side 20*a* of each slat 20 is oriented in parallel fashion to face the trailing edge of fence wing 10. FIG. 2, alternatively, depicts an embodiment wherein the hypotenuse side 20*a* of each slat 20 is oriented in parallel fashion to face the leading edge of fence wing 10. While the figures demonstrate the use of slats formed of a right triangle, any triangular shape is envisioned. Parallel orientation of the corresponding surfaces of subsequent slat will not always be possible, such as in some embodiments where alternate triangular shapes, i.e. equilateral, are employed.

In addition, the design and layout of individual fence sections in a dune-building obstacle differs from the standard T, V, W or \\\pattern of the prior art. The present invention uses an asterisk-pattern so that wind coming from any direction will create the maximum vortex possible. The fence includes a center-post and a plurality, about six, of fence wings extending radially from this post. An array of multiple winged obstacles is created by placing multi-winged fences in a row. Ideally, each fence is offset by one-half the distance between each obstacle to create a staggered pattern. Eolian particles thereby enter the array and are trapped by the leading or subsequent row.

Figure 3:
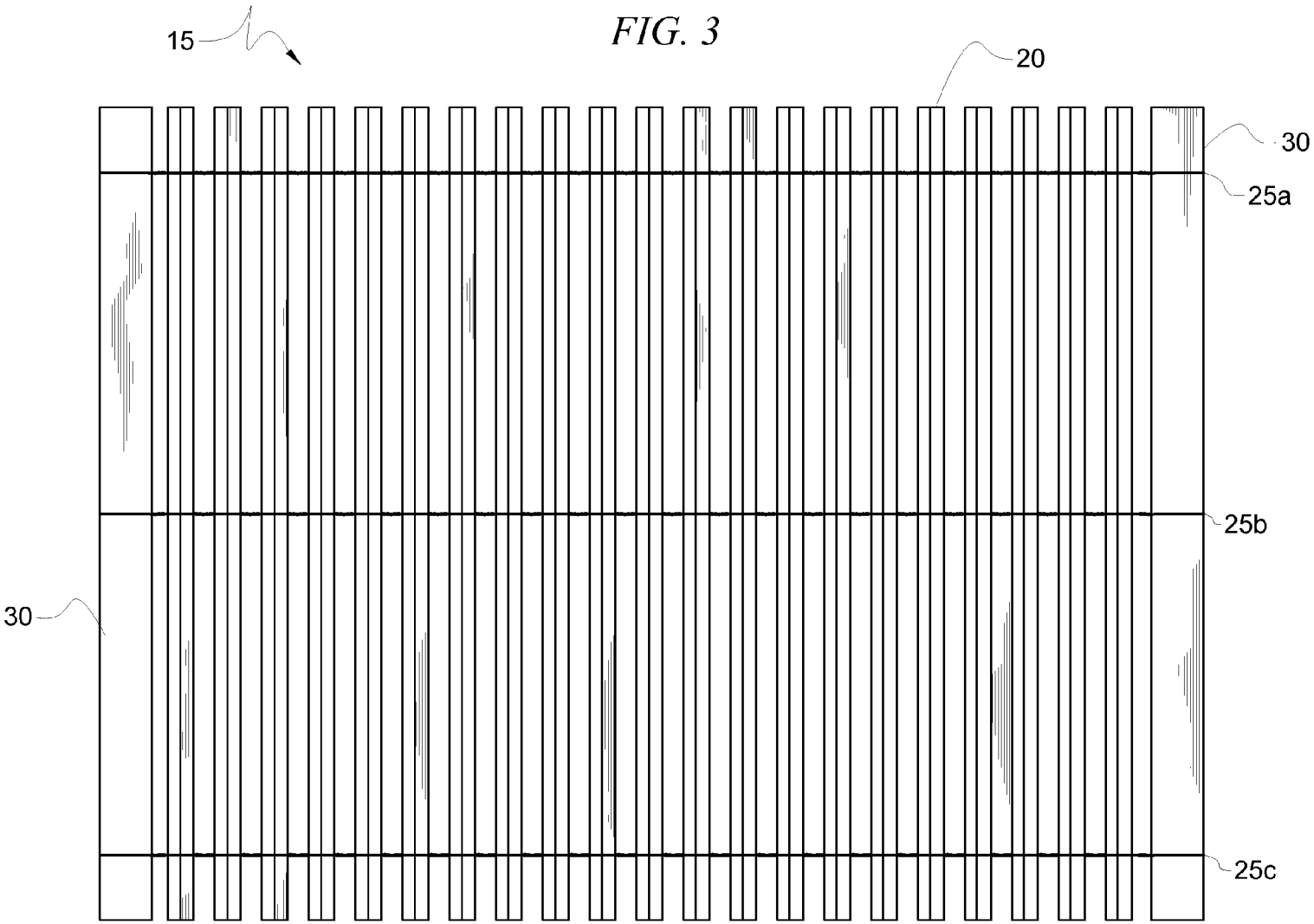
FIG. 3 is an elevational view of a fence wing.

FIG. 3 depicts one "wing" 15 of sand fence 10. In this embodiment, each "wing" 15 includes a four-foot by four-foot row of imperforate slats 20 having a substantially triangular cross-section. Each wing terminates in an end post 30 that is three inches (3") in diameter and eight feet (8') long. About four feet of that eight feet are driven into the ground (not shown).

Each slat of the wired fence is a triangular shaped, about four-foot long, wooden slat. Slats are most easily created by cutting a four-foot long 1"×1" in half, diagonally along its longitudinal axis. Although any type of wood or material can be used, the wood most commonly used is the same type as that used in the rectangular-slat fences of the prior art. The slats are then weaved together using materials and methods common to known fences.

Figure 4:
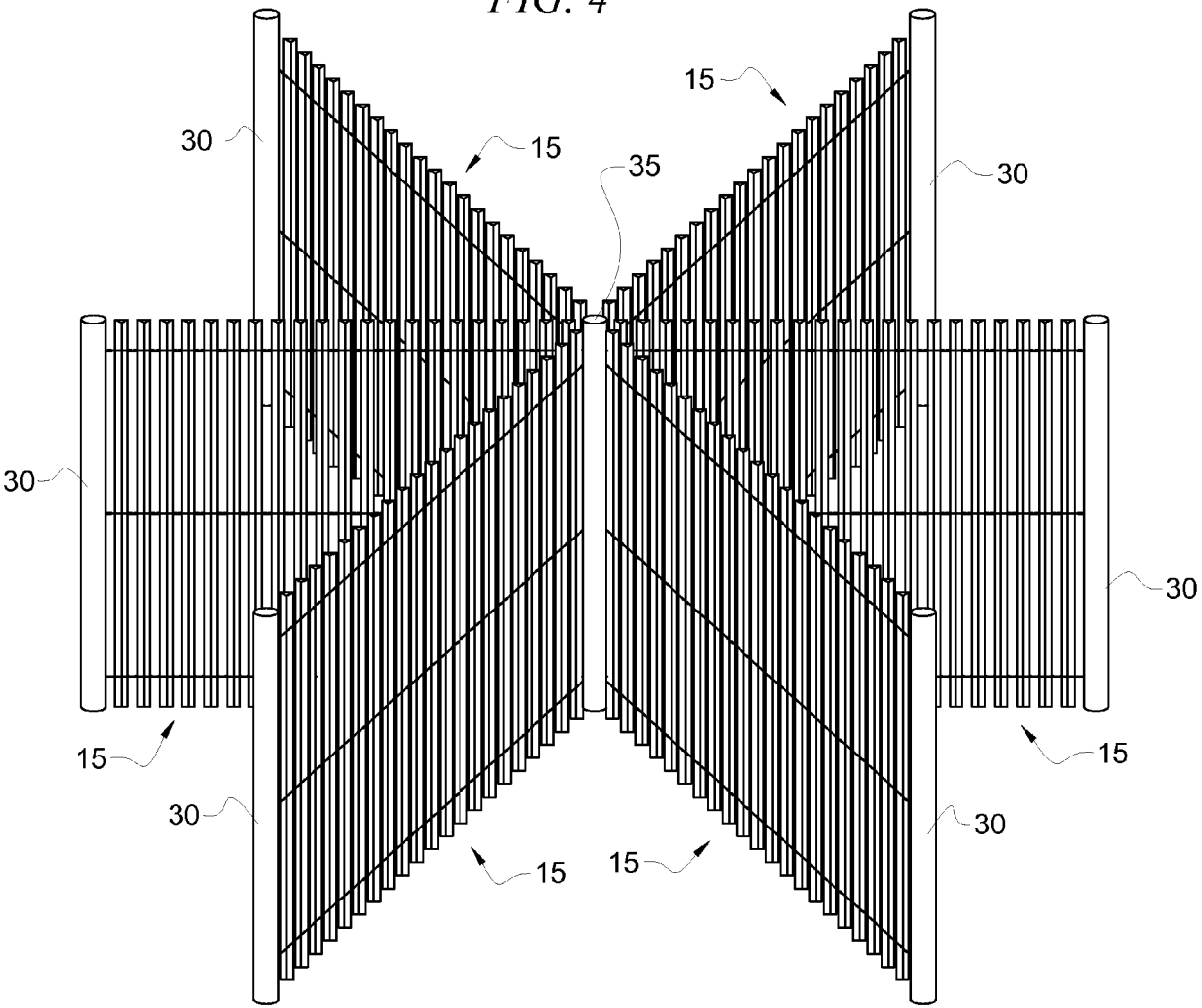
FIG. 4 is a perspective view of a fence section arranged in an asterisk-pattern.

In another embodiment, shown in FIG. 4, the inventive sand fence comprises a plurality of wings 15 radiating from a center post 35 in substantially symmetrical fashion. The structure of this illustrative embodiment includes a plurality, here six, of four-foot square wings connected to common center post 35 and anchored on each end by end posts 30. The asterisk-pattern of this embodiment provides a robust structure sufficient to survive extreme weather. Accordingly, this design provides the additional benefit of eliminating the cost associated with replacing damaged and lost fences.

Figure 5:
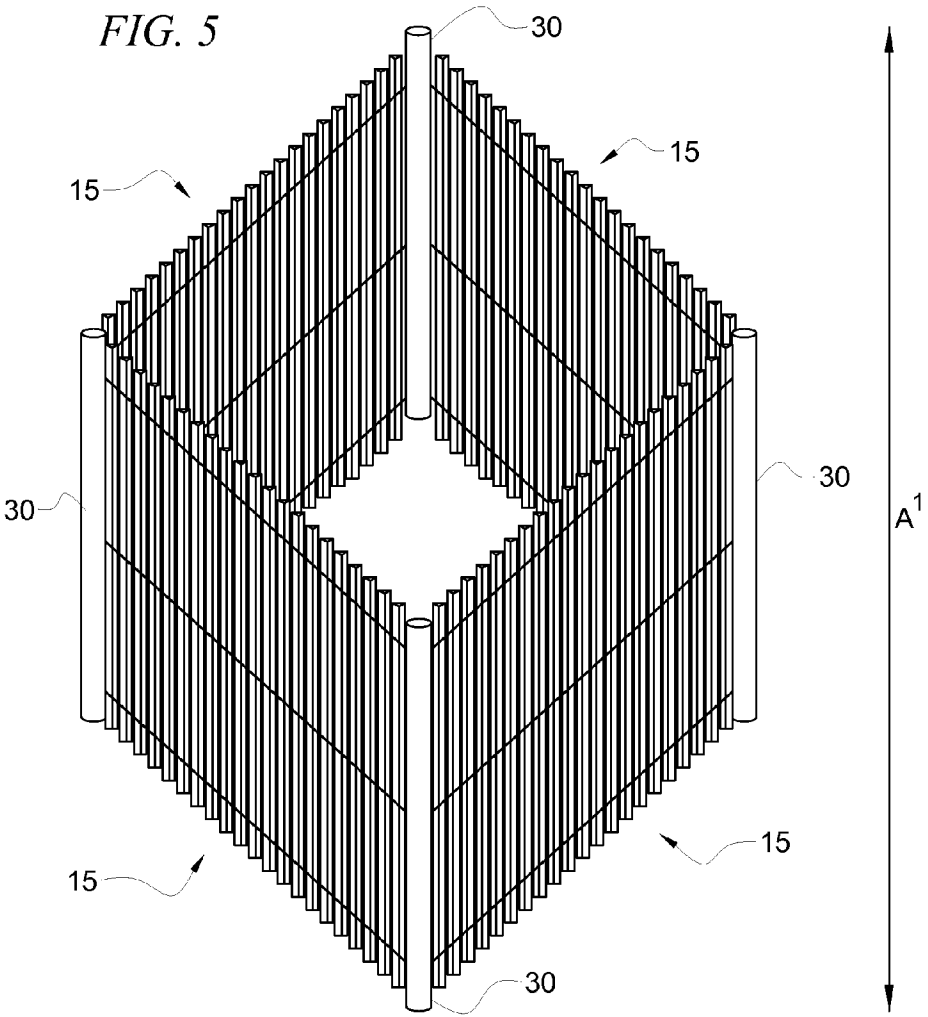
FIG. 5 is a perspective view of a fence section arranged in a closed, diamond-pattern.

The configuration shown in FIG. 5 allows installation of the sand fence within a zone where marine life, such as turtles and shorebirds, may be active. This configuration is diamond-shaped, with wings 15 connected to end posts 30 and the longitudinal axis $A^1$ of the closed structure aligned with the landward-seaward line; perpendicular to the shoreline. Animals moving along that path are diverted into a diagonal direction along the perimeter of the fence thereby eliminating the possibility of dead-end entrapment.

In addition, vegetation planted in the center of the section has an irrigation advantage over vegetation planted along the toe of a dune, i.e. on a flat contour. Here the fence will create a natural depression quickly and allow rain water to pool in the center more efficiently than water flowing with the slope of a dune fence.

Figure 6:
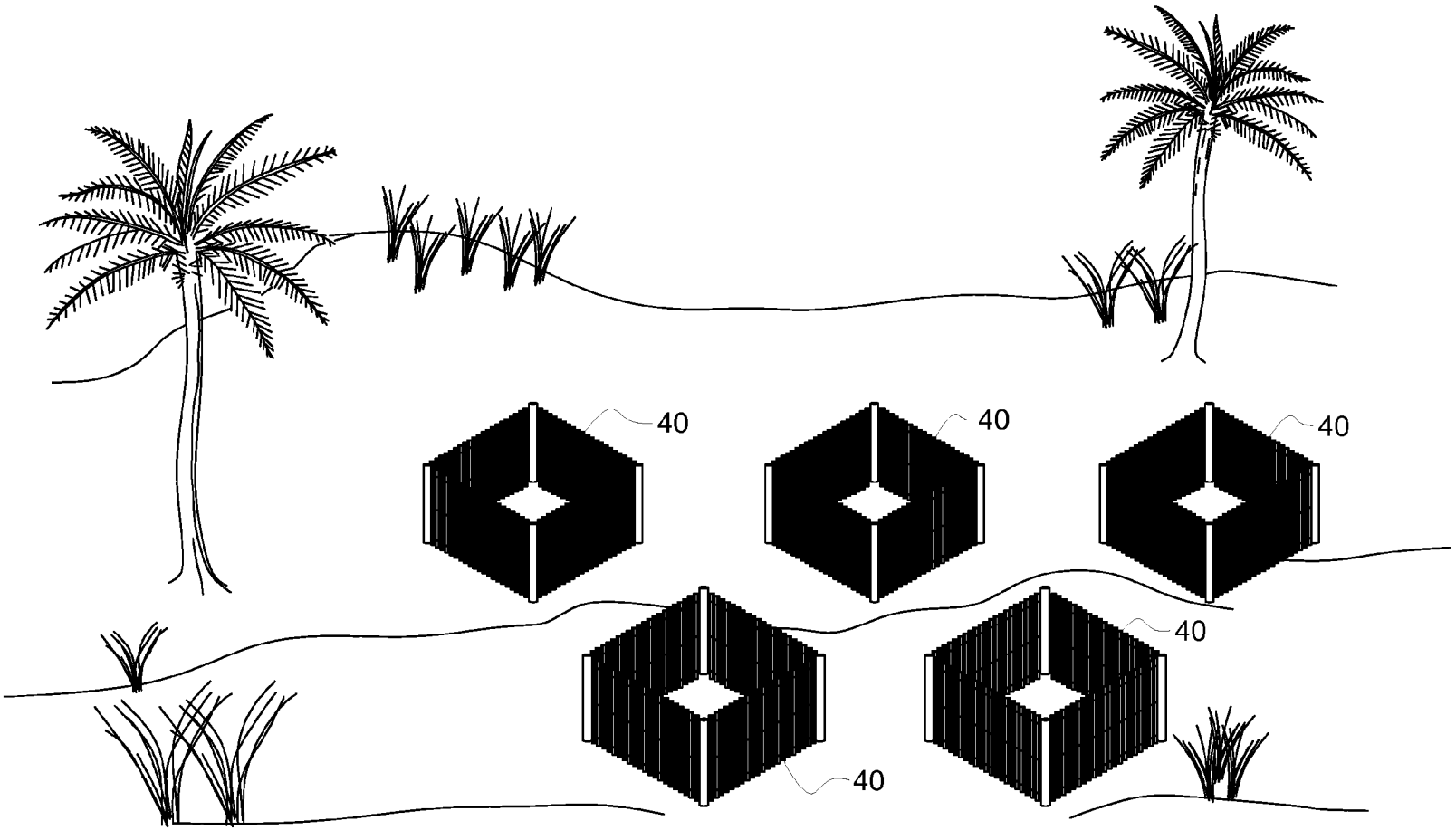
FIG. 6 is a perspective view of an array of diamond-pattern fence sections.

FIG. 6 shows one possible installation pattern of an array of the diamond-shaped, turtle friendly, fence sections. Here, the closed fence sections 40 are arranged such that a minimum width of about 8 feet is maintained between the parallel fence lines.

Figure 7:
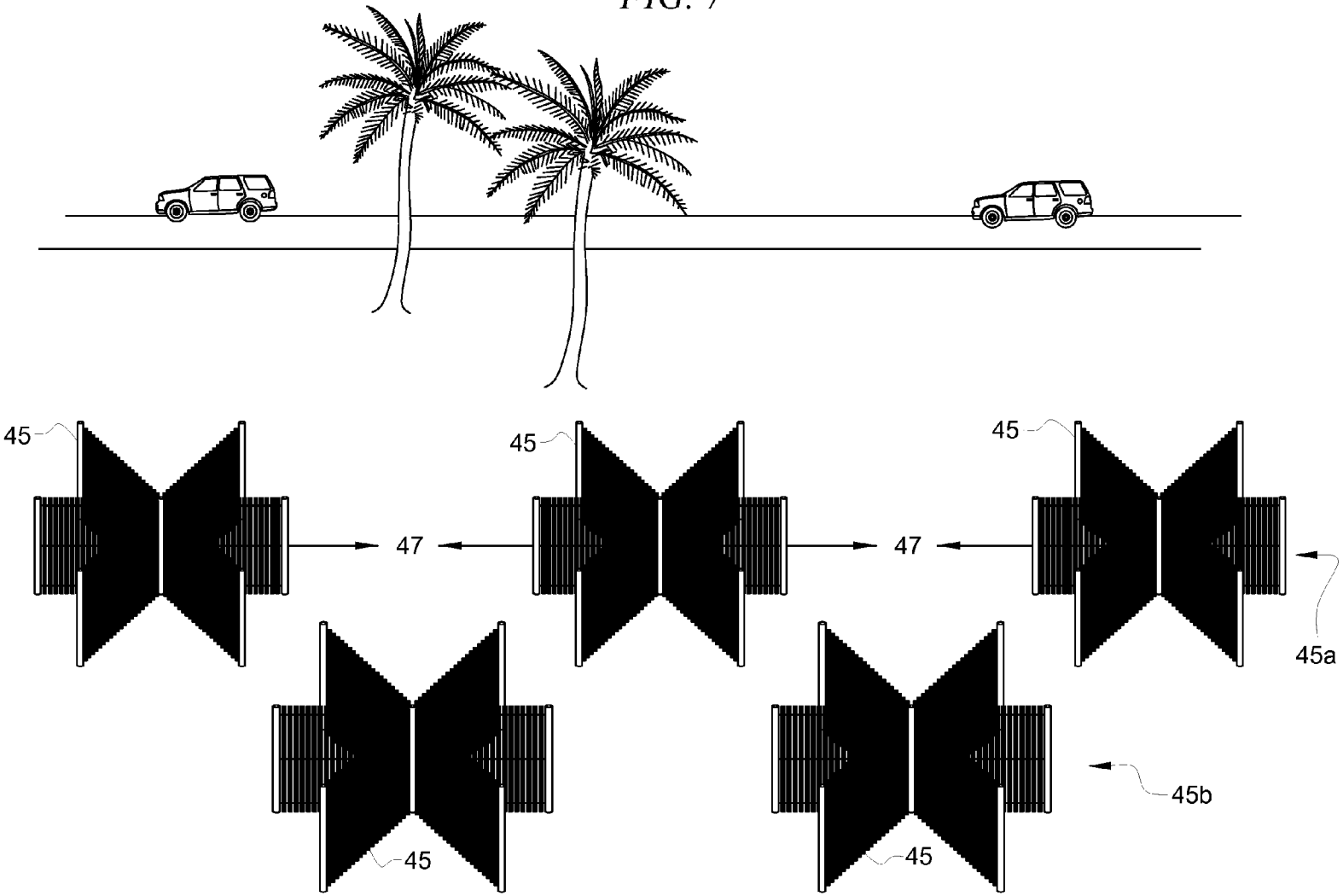
FIG. 7 is a perspective view of an array of asterisk-shaped fence sections.

A possible installation pattern of an array of the asterisk-shaped fence section 45 is shown in FIG. 7. The installation pattern shown here is based on each fence section having a diameter of eight feet. Each fence section is spaced along a line 45*a* at eight foot intervals, leaving an eight foot gap between each section. A second row 45*b* is then added to place a section in front of the gap 47 created by the previous row. The pattern is continued until the area requiring sand dune formation is covered with fence sections. A minimum of two rows is suggested.

The deployment pattern shown in FIG. 7 has numerous advantages. Flood water that reaches the installed sections is diverted into a tortuous path of travel after sufficient time has elapsed for sediment accretion and formation of small dunes. This helps expend energy. Moreover, low spots between the sections, formed once sand or sediment has begun to accrete and a topographic change is started, provides natural drainage for rainwater and provides water to vegetation planted or growing nearby. Finally, once the sections are buried by the accreting sand, a second layer can be placed on top of the buried layer by offsetting the pattern to avoid hitting the buried sections. In this manner, an eight-foot high dune could be created.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A drift fence, comprising:

an upstanding central post;

about six upstanding walls each directly connected to the upstanding central post and disposed in radial relation thereto;

each of the about six walls terminating at a free radially outermost end post having a lower end mounted into a ground surface;

each wall of the about six walls being formed by a plurality of upstanding, imperforate slat members disposed in spaced apart, lateral relation to one another wherein a transverse cross-section of each slat member is in a triangular configuration;

each slat member being connected to an adjacent slat member by a weaving wire attached to one side of the triangular cross-section of the slat member;

each slat member having a hypotenuse side that is oriented about 45 degrees to the weaving wire;

whereby the lateral spacing and the triangular cross-section eliminate parallel surfaces between adjacent sides of adjacent slat members to generate vortices as a depositional force to accrete wind-blown sand that is blown between the slats.

2. The drift fence of claim 1, further comprising:

the transverse cross-section having a right triangle configuration.

3. The drift fence of claim 1 having six upstanding walls connected to the upstanding central post and disposed in radial relation thereto.

4. A drift fence, comprising:

an upstanding central post;

about six upstanding walls each directly connected to the upstanding central post and disposed in radial relation thereto;

each of the about six walls terminating at a free radially outermost end post having a lower end mounted into a ground surface;

each wall of the about six walls being formed by a plurality of upstanding, imperforate slat members disposed in spaced apart, lateral relation to one another wherein a transverse cross-section of each slat member is in a triangular configuration;

each slat member being connected to an adjacent slat member by a weaving wire attached to one side of the triangular cross-section of the slat member;

each triangular slat member having a hypotenuse side that is oriented substantially parallel to the weaving wire;

whereby the lateral spacing and the triangular cross-sections eliminate parallel surfaces between adjacent sides of adjacent slat members to generate vortices as a depositional force to accrete wind-blown sand that is blown between the slats.

5. The drift fence of claim 4, further comprising:

the transverse cross-section having an equilateral triangle configuration.

6. The drift fence of claim 4 having six upstanding walls connected to the upstanding central post and disposed in radial relation thereto.

* * * * *